United States Patent [19]

Poth

[11] Patent Number: 4,507,641

[45] Date of Patent: Mar. 26, 1985

[54] DRIVING MECHANISM FOR A THREE-POSITION ELECTRICAL SWITCH

[75] Inventor: Rainer Poth, Bad Vilbel, Fed. Rep. of Germany

[73] Assignee: Siemens Aktiengesellschaft, Berlin and Munich, Fed. Rep. of Germany

[21] Appl. No.: 526,948

[22] Filed: Aug. 29, 1983

[30] Foreign Application Priority Data

Oct. 27, 1982 [DE] Fed. Rep. of Germany ..... 3239839

[51] Int. Cl.[3] ..... H01H 85/00

[52] U.S. Cl. ..... 337/6; 200/153 SC; 335/189

[58] Field of Search ..... 337/4, 5, 6, 8; 335/189; 200/153 SC, 153 G

[56] References Cited

U.S. PATENT DOCUMENTS 4,204,103 5/1980 Jährig et al. ..... 200/153 SC 4,336,516 6/1982 Bratkowski et al. ..... 200/153 SC

OTHER PUBLICATIONS

Brush Switch Gear Limited England, Oct. 1969, "Instruction Manual Installation, Operation and Maintenance Instructions for Type NSM High Voltage Non--Extensible Ring Main Unit for Indoor or Outdoor Use".

*Primary Examiner*—Harold Broome

*Attorney, Agent, or Firm*—F. W. Powers; J. L. James

[57] ABSTRACT

A three-position electrical driving mechanism having a jump-drive sub-assembly, a pivotable actuator and associated spring arrangement for storing energy, a detent arrangement and associated latches for holding the detents in place, a release arrangement for disengaging the detents from the latches, and a storage drive sub-assembly which is operable in response to a blown fuse or an open circuit trip. This switch requires the operator to perform the same switching operation each time the switch is utilized, and therefore errors that occur when an operator must perform several different operations are avoided.

2 Claims, 5 Drawing Figures

DRIVING MECHANISM FOR A THREE-POSITION ELECTRICAL SWITCH

BACKGROUND OF THE INVENTION

This invention relates to a driving mechanism for a three-position electrical switch comprising a jump-drive sub-assembly having a switching shaft which is rotatable between ON, OFF and EARTH switching positions, and a storage drive sub-assembly having a disconnecting spring which releases its stored spring force when a fuse is blown or an open circuit trip has occurred.

Existing driving mechanisms for three-position electrical switches require large operating forces. Additionally, high breaking forces are required when a circuit is interrupted by a blown fuse. Furthermore, existing storage drive sub-assemblies take up a large amount of space. Also, a switching operation from ON to OFF can be carried out only by the storage drive sub-assembly, and not by the jump drive sub-assembly (see for example instructions for use for closed circuit installations of the NSM type from October 1969, Brush Switch Gear Limited England).

SUMMARY OF THE INVENTION

The present invention has been developed primarily, though not exclusively, to provide a driving mechanism for a three-position electrical switch which requires low operating and breaking forces, is small, can be switched via the storage drive sub-assembly from ON to OFF when a fuse is blown or when an open circuit trip has occurred, and can be switched via the jump drive sub-assembly when operated manually.

In general, the invention features, in one aspect, a driving mechanism for a three-position electrical switch having:

a jump-drive sub-assembly having a switching shaft which is rotatable between ON, OFF and EARTH switching positions;

a pivotable actuator operable to rotate the switching shaft between its switching positions;

a spring arrangement coupled with the actuator and operable to store spring energy upon rotation of the actuator in either direction from a mean position;

a detent arrangement coupled with the switching shaft and with the spring arrangement;

a circumferentially spaced arrangement of latches disposed around the switching shaft and engageable with the detent arrangement in order to hold the switching shaft in any one of its switching positions;

a release arrangement coupled with the actuator and operable, upon rotation of the actuator from the mean position through a predetermined angle, to disengage the detent arrangement from the latch arrangement and thereby allow the stored spring energy to act upon the switching shaft to rotate the latter rapidly to the ON position or to the EARTH position depending upon the direction of rotation of the actuator; and a storage drive sub-assembly coupled with the switching shaft and having a disconnecting spring which is operable to release a stored spring force when a fuse of a fusing arrangement is blown or when an open circuit trip has occurred.

wherein the switching shaft is operable automatically by the storage drive sub-assembly when a fuse is blown or when an open circuit trip has occurred, and the switching shaft is operable manually via the jump drive sub-assembly.

In general, the invention features, in another aspect, a driving mechanism for a three-position electrical switch, having;

a jump-drive sub-assembly having a switching shaft which is rotatable between ON, OFF and EARTH switching positions;

a pivotable actuator operable to rotate the switching shaft between its switching positions, the pivotable actuator comprising a sleeve, a helical spring surrounding the sleeve, a first retainer secured to the sleeve and engageable with one end of the spring, and a second retainer secured to the switching shaft and engageable with another end of the spring;

a releasable detent arrangement coupled with the switching shaft and with the spring, the arrangement comprising a detent carrier secured to the shaft and carrying a pair of detents, and circumferentially spaced pairs of latching rollers fixedly arranged around the switching shaft to each determine a respective one of said switching positions when engaged by the detents;

a manually operated lever secured to the sleeve to rotate the latter in a direction from OFF to ON and from OFF to EARTH and vice versa, thereby taking with it, via the first retainer, the end of the spring which is in its path, while the other end of the spring is held by the second retainer, and the detents are engaged with the rollers associated with the starting position;

a release device secured to the sleeve for rotation therewith and operable, when the particular spring end engaged by the first retainer has moved through a predetermined angle, to release the detent situated in the relevant direction of rotation from engagement with its roller so that the switching shaft and the detent carrier are then rotated rapidly by the action of the other end of the spring and the second retainer from OFF to ON, from OFF to EARTH and from EARTH to OFF; and a storage drive sub-assembly comprising a disconnecting spring which has its spring force releasable when a fuse of a fusing arrangement is blown or when an open circuit trip has occurred; wherein, 1. a crank lever is secured to the switching shaft and engages a switch rod of the storage drive sub-assembly, said switch rod carrying a support roller and said disconnecting spring;

2. the circuit breaker spring is attached at one end to an end of the switch rod remote from the crank lever and is attached at its other end to a rocker pivotally mounted on a first pin which engages a first slot formed in the switch rod and a plate;

3. the plate receives a second pin which engages a second slot formed in the switch rod and which forms the axis of rotation for a detent lever which is pivotable with a detent shoulder arranged adjacent to said support roller;

4. the detent lever has a recessed seat for receiving said support roller and carries a cam roller urged under spring force to engage a rocker arm pivotable about a fixed axis;

5. the detent shoulder of the detent lever lies on an arc which is eccentric to the axis of rotation of the detent lever;

6. the free end of said rocker arm is engageable by a support detent and by a release detent to hold the free end and prevent the rocker arm from pivoting, the support detent being moveable out of a blocking position by a connecting link connected to said crank lever, and the release detent being moveable out of the blocking position via a trip rod controlled by a fusing arrangement and/or an open circuit trip;

7. a blocking detent is pivotally mounted on said rocker for movement under spring action below a fixed stop, said blocking detent being moveable against the spring action to engage with a hook of said detent lever, and the end of the blocking detent facing said fixed stop lying on an arc eccentric to the pivot axis of the blocking detent; and 8. the hook of said detent lever lies on an arc eccentric to said second pin.

In preferred embodiments the invention features a three-position electrical switch which incorporates either of the previously described driving mechanisms.

In the utilization of this novel driving mechanism there is the advantage that an operator only has to carry out one switching operation each time. This is very advantageous because it prevents error that can result when an operator must perform different switching operations each time.

Other features and advantages of the invention will be apparent from the following detailed description, and from the claims.

For a full understanding of the present invention, reference should now be made to the following detailed description and to the accompanying drawings.

BRIEF DESCRIPTION OF THE DRAWINGS

An embodiment of the driving mechanism according to the invention, for a three-position electrical switch, will now be described in more detail, by way of example only, with reference to the accompanying drawing, which are described as follows.

DETAILED DESCRIPTION

Figure 1:
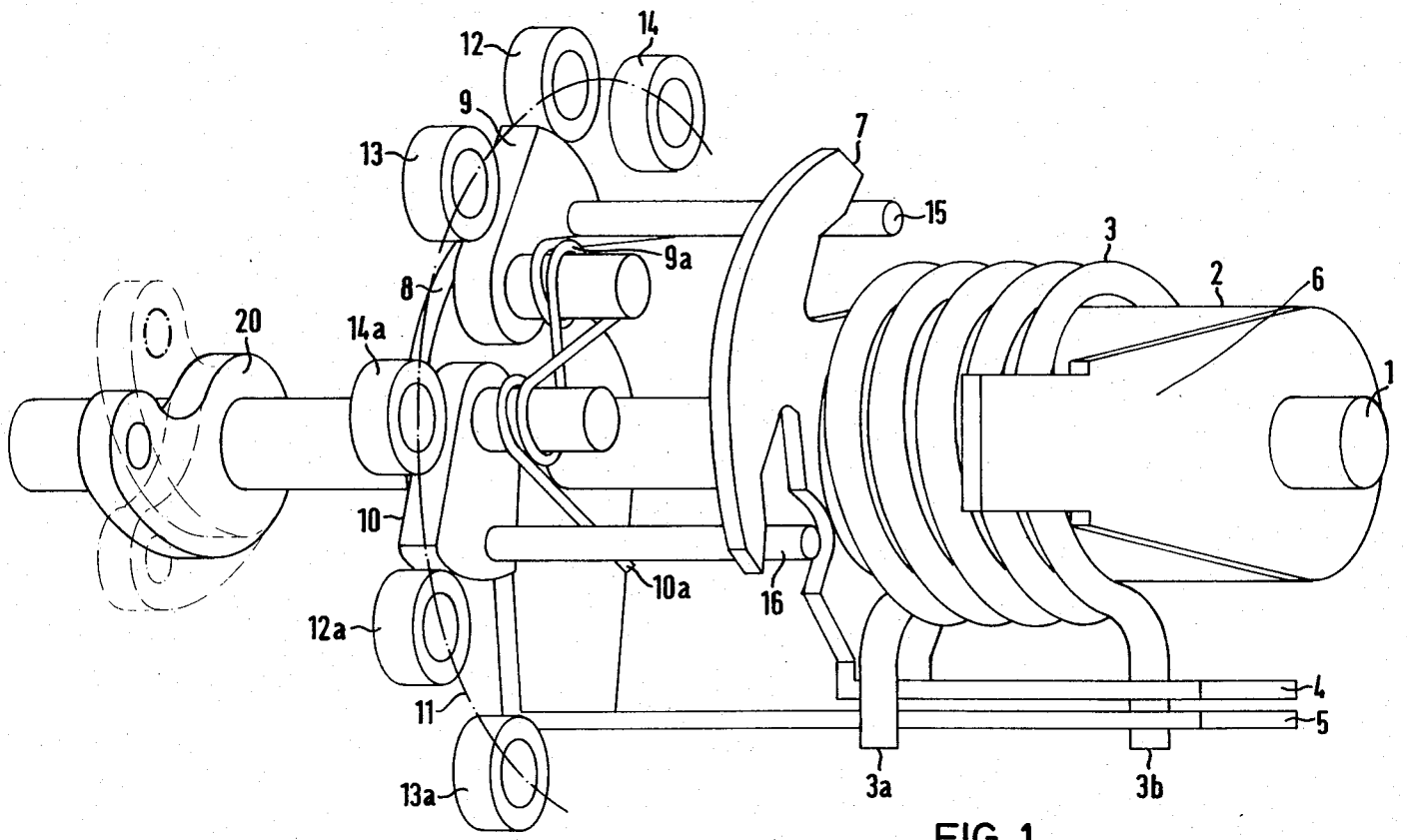
FIG. 1 is a perspective view of a jump-drive sub-assembly of the driving mechanism.

Referring now to the jump-drive sub-assembly shown in FIG. 1, switch shaft 1, is rotatable from a middle OFF position in one direction to an ON position, and in the opposite direction to an OFF position.

When switch shaft 1 is rotated from the OFF position to the left (counter-clockwise), switching to the ON position occurs. When it is rotated in the opposite direction, switching to EARTH occurs. The ON and EARTH positions are interchangeable.

A pivotable actuator for shaft 1 comprises sleeve 2 mounted on switch shaft 1, which has helical bending spring 3 wound coaxially around it.

Bending spring 3 comprises offset leg ends 3*a*, 3*b*, which are separated from each other by cam 4 (first retainer) which is arranged between them, and second retainer 5 which is arranged below cam 4.

Cam 4, a tension lever 6 and a rocker arm 7, are united with sleeve 2. Tension lever 6 is the attaching point for a handle (not shown).

Retainer 5, on the other hand, is secured to switch shaft 1 together with detent carrier 8, which carries two detents 9, 10.

Pairs of support rollers 12 and 12*a*, 13 and 13*a*, and 14 and 14*a* are in fixed arrangement in an arc around switch shaft 1. The element carrying support rollers 12–14*a* is omitted from the drawing for the sake of clarity.

Support rollers 12 and 12*a* are associated with the OFF position shown in FIG. 1.

Support rollers 13 and 13*a* define the ON position, while support rollers 14 and 14*a* are provided for the EARTH position.

Sleeve 2 is rotatable around switch shaft 1, by means of tension lever 6, from OFF in the ON direction and from OFF in the EARTH direction, and vice versa.

The method of operation of the jump drive sub-assembly shown in FIG. 1 is as follows:

When sleeve 2 is rotated from the OFF switch position (shown) to the ON position, bending spring leg 3*b*, situated in the direction of rotation, is taken up by cam 4 which is secured to sleeve 2, while bending spring leg 3*a* is retained by retainer 5, and detents 9 and 10 are clamped between support rollers 12 and 12*a*, as shown.

When helical bending spring 3 has been sufficiently pre-tensioned for switching on, that is, when a predetermined angle of rotation of bending spring leg 3*b* has been achieved, detent 10, situated in the direction of rotation, is pivoted free of support roller 12*a* by the rocker arm 7, via a (second) guide rod 16 acting against a spring 10*a*.

As soon as detent 10 leaves support roller 12*a*, retainer 5 released with detent 10 and switch shaft 1 connected to retainer 5 is rotated with a jump into the ON switch position in the direction of rotation by bending spring leg 3*a*, which was previously secured by retainer 5. This releases helical bending spring 3, and detents 9, 10 now extend between support rollers 13 and 13*a*.

When switching is carried out from OFF to EARTH, bending spring leg 3*a* is taken up by cam 4 and bending spring leg 3*b* is retained by retainer 5. Detents 9, 10 extend, as before, between support rollers 12 and 12*a*.

After bending spring leg 3*a* has passed through its path of rotation, detent 9, which is situated in the direction of rotation, is pivoted free of support roller 12*a* by rocker arm 7 via a (first) guide rod 15 which acts against spring leg 9*a*.

When detent 9 has left support roller 12, the support is removed from retainer 5. Switch shaft 1 is now rotated suddenly into the EARTH position by bending spring leg 3*b* (retained up till now by retainer 5). In this switch position, detents 9, 10 extend between support rollers 14 and 14*a*. The spring legs 9*a* and 10*a* effect the swinging back of the detents from the pivoted-out position to their respective positions between support roller pairs 12 and 12*a*, 13 and 13*a*, and 14 and 14*a*.

Another crank lever 20 is secured to switch shaft 1 as well as to retainer 5 and detent carrier 8. Crank lever 20, together with switch shaft 1, is pivotable into the switch positions OFF, EARTH, ON, and vice versa. The unbroken outline of crank lever 20 indicates the OFF switch position, while the dash outlines of the crank lever 20 indicates the ON and EARTH switch positions.

Referring now to the storage drive sub-assembly shown in FIGS. 2 to 5, only two elements from FIG. 1 are shown. These are switch shaft 1, shown in section, and crank lever 20. These two parts, 1, 20, are the members of the jump drive sub-assembly shown in FIG. 1 which connect the storage drive sub-assembly, shown in FIGS. 2 to 5, and the jump drive sub-assembly.

Figure 2:
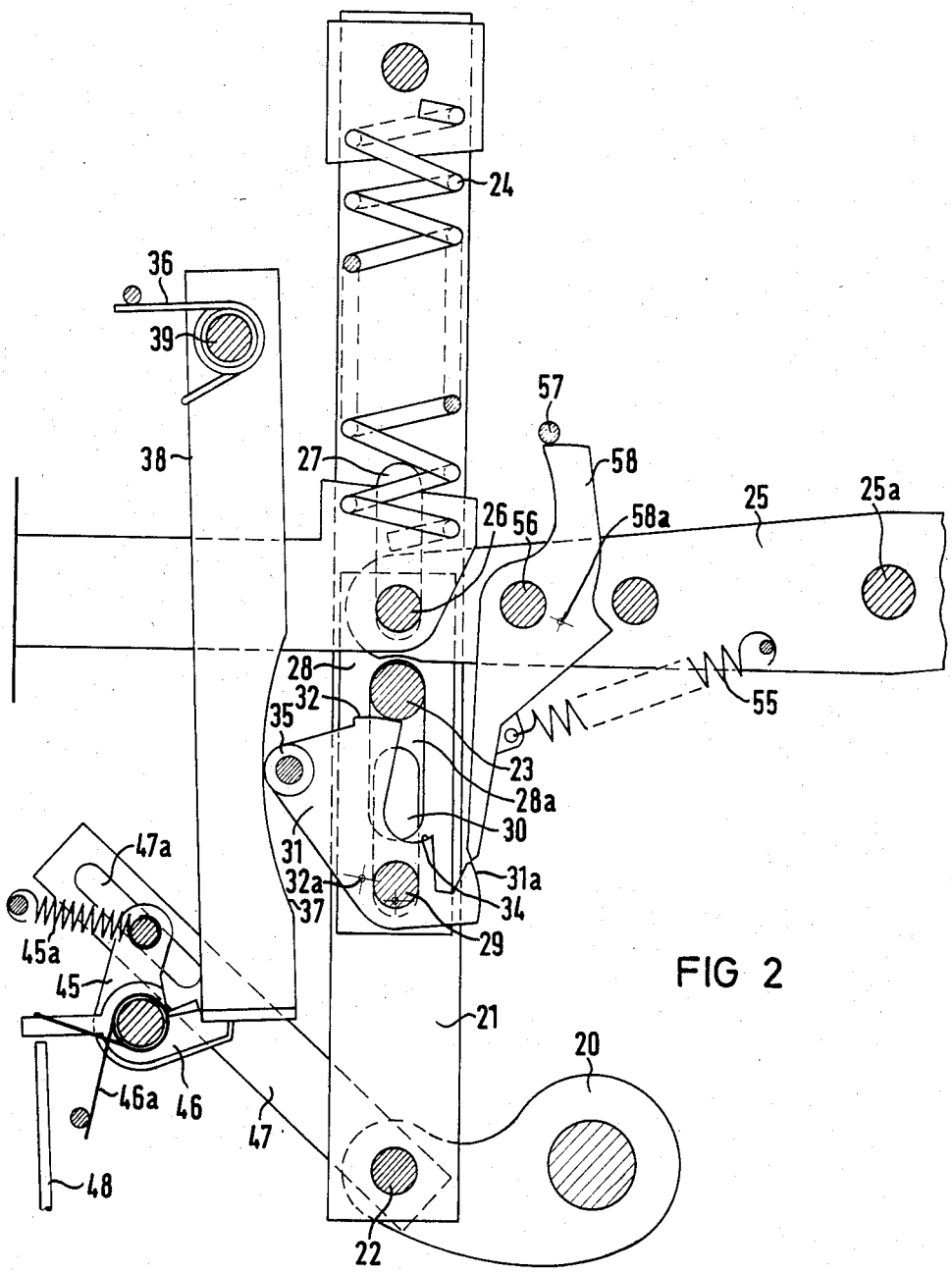
FIG. 2 is a side view of a storage drive sub-assembly of the mechanism in the OFF position, with a disconnecting spring under tension.
Figure 3:
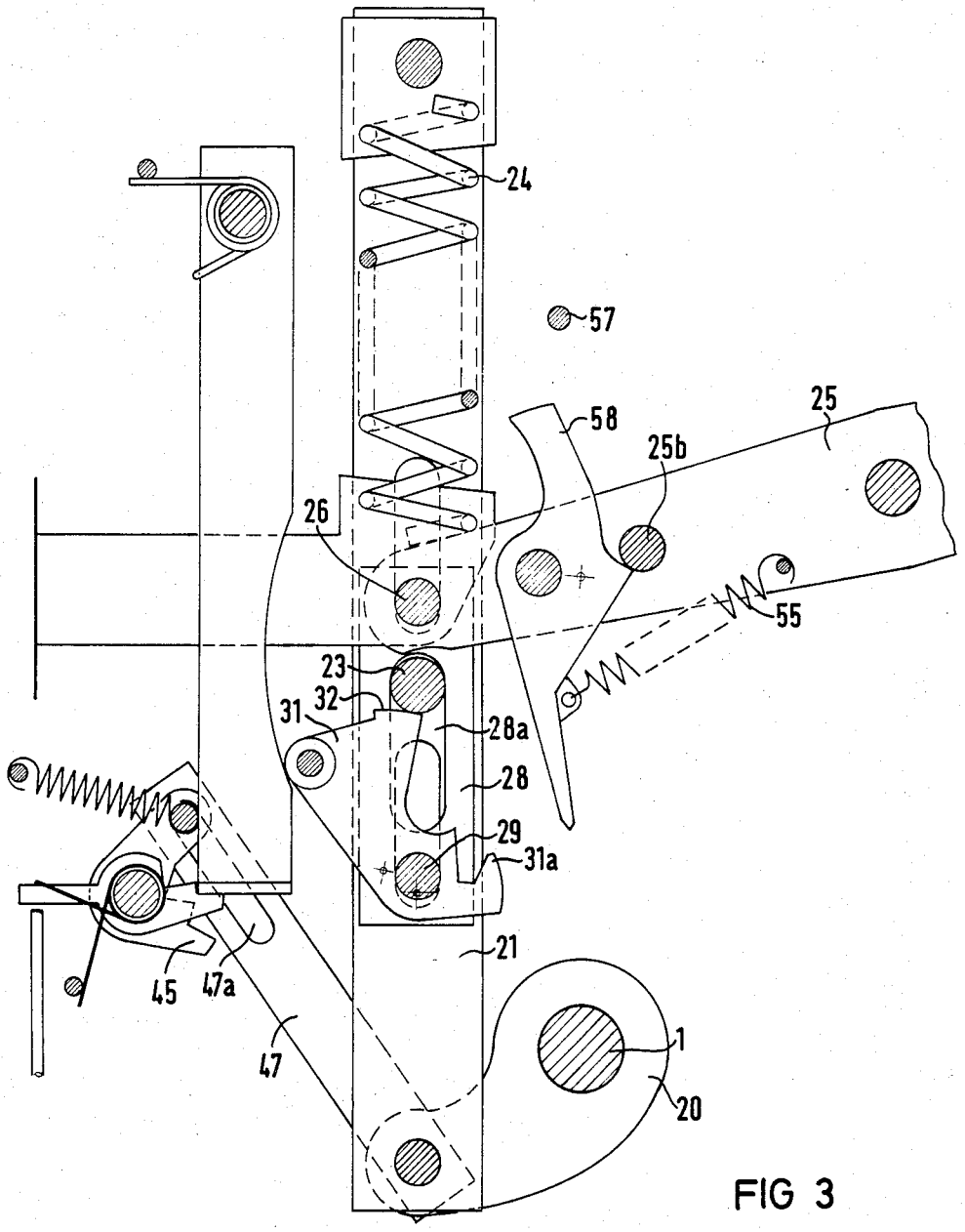
FIG. 3 is a view similar to FIG. 2, but with the storage drive sub-assembly in the ON position, and the disconnecting spring under tension.
Figure 4:
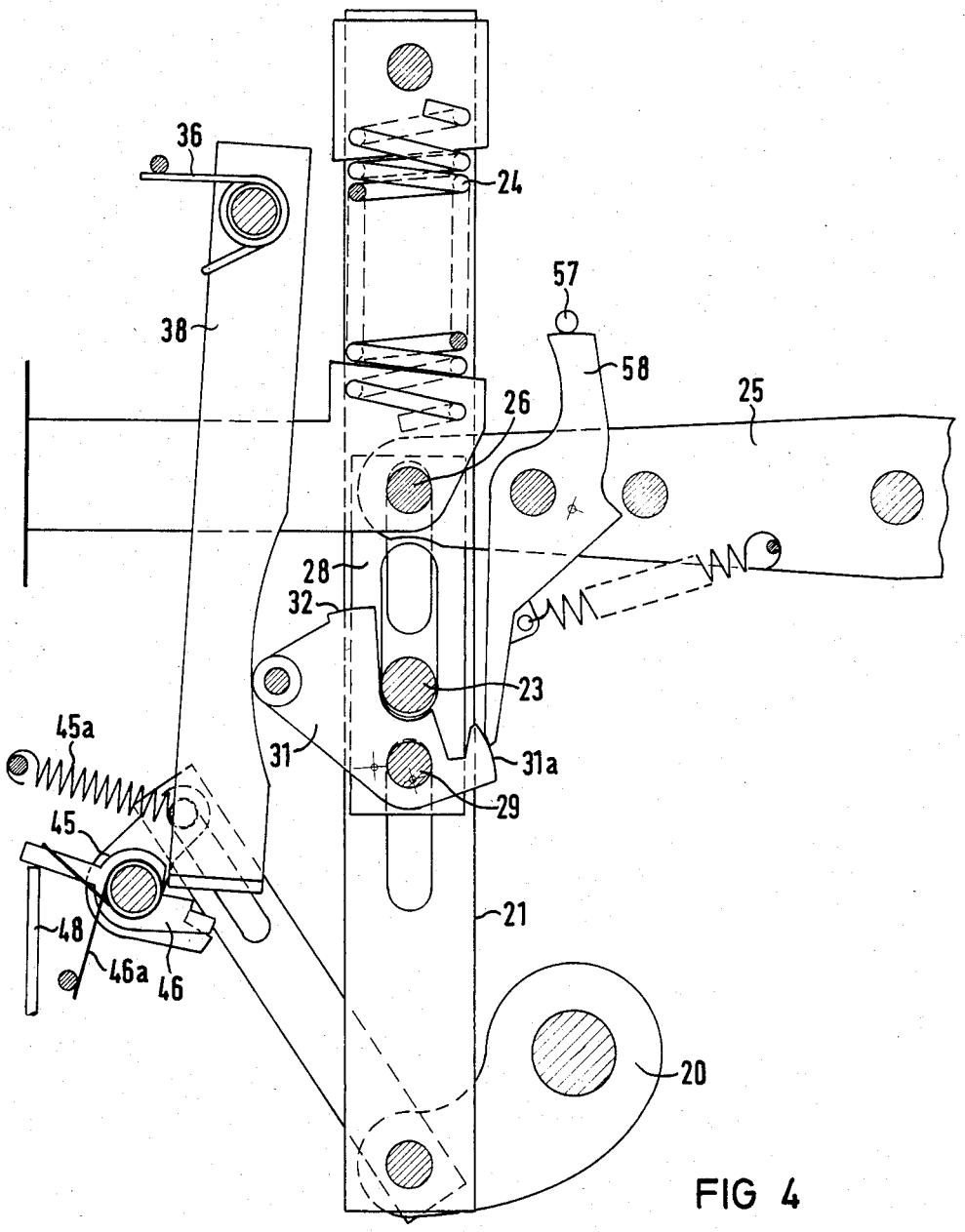
FIG. 4 is a view similar to FIG. 2, but with the storage drive sub-assembly in the OFF position, and disconnecting spring released.
Figure 5:
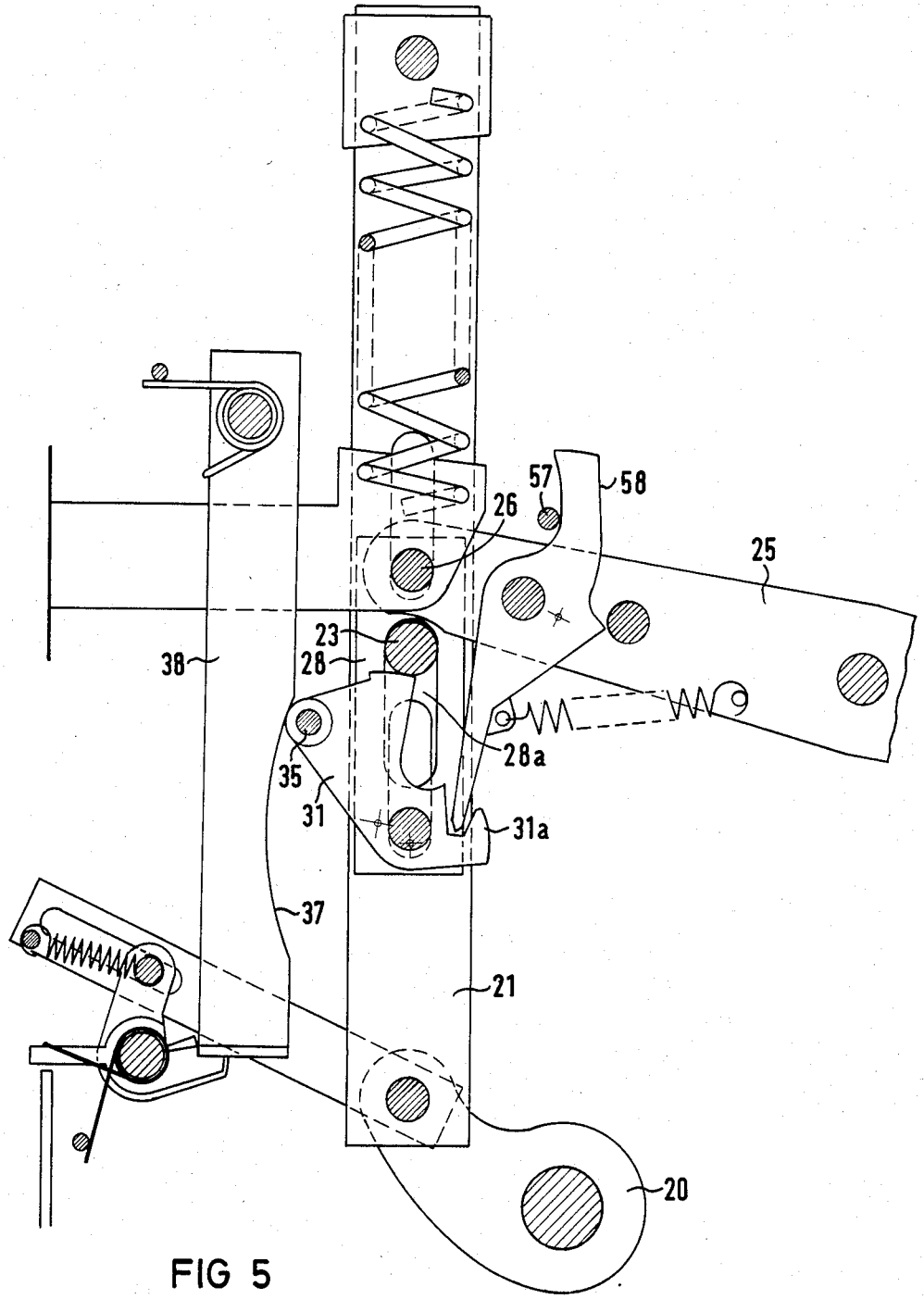
FIG. 5 is a view similar to FIG. 2, but with the storage drive sub-assembly in the EARTH position, and the disconnecting spring under tension.

In FIG. 2 all the reference numbers are entered, while in FIGS. 3 to 5 only those numbers which are referred to in the description of the method of carrying out the switching operations, are entered.

As shown in FIG. 2, crank lever 20 is connected by a hinge to switch rod 21 at fulcrum 22.

Switch rod 21 carries support roller 23 and disconnecting spring 24. Spring 24 is released when either a fuse is "blown" or an open circuit trip of a shunt trip device has occurred.

One end of disconnecting spring 24 is attached to the upper end of switch rod 21 and the other end is attached to a first pin 26 of rocker 25, which is pivotable about rotation point 25*a*.

First pin 26 engages firt slot 27 (FIG. 2) of switch rod 21, and longitudinal slot 28*a* of cover plate 28.

A second pin 29 also engages plate 28 and a second slot 30 of switch rod 21. Pin 29 is also the axis of rotation for detent lever 31.

Detent lever 31 has an arcuate detent shoulder 32. Central point 32*a* of the arc of detent shoulder 32 lies eccentric to second pin 29.

Detent lever 31 includes, detent shoulder 32, recessed seat 34 for support roller 23, and cam roller 35.

Rocker arm 38, which is pivotable about fixed axis 39, has curved surface 37 which is held against cam roller 35 by spring 36.

Rotation of the free end of arm 38 is blocked by support detent 45 and release detent 46.

Support detent 45 can be moved out of the blocking position by crank lever 20 which acts via connecting link 47, against spring 45*a*.

Blocking pawl 46, which is held in place by spring 46*a*, can be moved out of the blocking position by trip rod 48.

The trip rod 48 is operated by an open circuit trip of a shunt trip device or an indicator pin of a fuse (not shown). During operation by an open circuit trip or by an indicator pin of a fuse, the trip rod 48 contacts the blocking pawl 46 and turns it against the force of spring 46*a* in such a way that the rocker arm 38, and with it the stored spring tension of disconnecting spring 24, is released.

Blocking detent 58, mounted on rocker 25, is pivotable, below fixed stop 57, about pivot pin 56.

Blocking detent 58 is pivotable onto hook 31*a* of detent lever 31, in response to the force exerted by spring 55.

The upper end of blocking detent 58, which faces fixed stop 57, lies on an arc eccentric to pivot pin 56. The central point of the arc is located at 58*a*.

The method of operation of the storage drive sub-assembly, shown in FIGS. 2 to 5, will now be described.

Referring to FIG. 2, the storage drive is shown in the OFF position with disconnecting spring 24 under tension.

Crank lever 20 is placed in the middle OFF position.

Support roller 23 rests on shoulder 32 of detent lever 31. Due to the eccentricity between second pin 29 and central point 32*a* of the arc of shoulder 32, detent lever 31 is pressed along with cam roller 35 against curved surface 37 of rocker arm 38 by disconnecting spring 24.

To prevent pivoting of rocker arm 38, its free end is blocked by support detent 45 and by blocking pawl 46.

Hook 31*a* of detent lever 31 will now move to a position exactly below the lower end of blocking detent 58.

Referring now to FIG. 3, the storage drive is shown in the ON position, with disconnecting spring 24 under tension.

This position is reached by the previously described operation of the jump drive (see FIG. 1) starting from the OFF position, with disconnecting spring 24 under tension.

Crank lever 20 moves, during switching from OFF to ON, from its middle position to its lower position. This downward motion also pulls both switch rod 21 and support roller 23 downward.

Since support roller 23 is supported on detent shoulder 32, detent lever 31 is drawn downward with it.

Rocker 25 is also pivoted downward due to the motion of second pin 29, cover plate 28 and first pin 26.

Blocking detent 58 is drawn against stop 25*b* by spring 55.

The downward motion of crank lever 20 causes downward motion of connecting link 47, which pivots support detent 45 against spring 45*a*, and out of its blocking position. This occurs just before the ON position is reached as a result of an appropriate arrangement of longitudinal slot 47*a*.

To switch from ON to OFF by means of the jump drive mechanism, switch rod 21 together with support roller 23, are pushed upward by crank lever 20.

Support roller 23 is located at the upper end of longitudinal slot 28*a*, so that plate 28 is moved upward by upward motion of the roller.

Plate 28 in turn, pulls up detent lever 31, and rocker 25 pivots above first pin 26 and into the OFF position.

Blocking detent 58 is placed against the end of the pivot path of rocker 25 on fixed stop 57, and the lower end of detent 58 engages exactly behind hook 31*a*.

The upwards movement of crank lever 20 displaces connecting link 47 and permits support detent 45 to pivot under rocker arm 38. This prevents rotation of arm 38 and results in the position shown in FIG. 2.

Referring to FIG. 4, the storage drive is shown in the OFF position, with disconnecting spring 24 released.

To switch from the ON position described above, with disconnecting spring 24 under tension, to the OFF position by means of disconnecting spring 24, trip rod 48 is pushed upward against spring 46*a* and blocking pawl 46 is pivoted out of its blocking position.

Rocker arm 38 is thereby released and pivoted to the left against the force exerted by spring 36.

Detent lever 31 is support by rocker arm 38 and therefore lever 31 follows arm 38 by rotating around second pin 29 as a result of the pressure of disconnecting spring 24 acting on detent shoulder 32.

The motion of detent lever 31 releases support roller 23, which moves upward as a result of the upward force exerted by disconnecting spring 24 via second pin 29, plate 28 and first pin 26.

At the same time, rocker 25 moves into the OFF position, in which blocking detent 58 abuts fixed stop 57, and the lower end of blocking detent 58 moves against hook 31*a* of detent lever 31.

In order to re-tension disconnecting spring 24, crank lever 20 must be jumped due to the action of bending spring 3 (FIG. 1). Spring 3 pushes switch rod 21 upward while rocker 25 remains stationary due to blocking detent 58 which is supported on fixed stop 57.

First pin 26, plate 28 and second pin 29 also remain stationary.

Disconnecting spring 24 is suspended by one end on switch rod 21 and by the other end on first pin 26 of rocker 25, so that it is tensioned with an upward movement of switch rod 21, while releasing bending spring 3.

When bending spring 3 is released, detents 9, 10 pivot between support rollers 12 and 12*a* (FIG. 1).

At the same time that detents 9, 10 pivot between the pair of support rollers 12 and 12*a*, detent lever 31 is placed below support roller 23 and rocker arm 38 follows cam roller 35, as it pivots due to the force exerted by spring 36.

Support detent 45 and blocking pawl 46 pivot into their blocking positions due to the forces exerted by springs 45*a* and 46*a* respectively.

Meanwhile, hook 31*a* of detent lever 31 rotates free of blocking detent 58, so the position shown in FIG. 2 results.

Referring now to FIG. 5, the storage drive mechanism is shown in the OFF position, with the disconnecting spring relaxed.

Switch shaft 1 moves to the EARTH position as a result of the release of bending spring 3, previously described. Crank lever 20 is rotated out of its middle position and into its upper position, so that switch rod 21 together with support roller 23, are pushed upward.

Support roller 23 lies at the upper end of longitudinal slot 28*a*.

Plate 28 is also moved upward with switch rod 21.

Plate 28 takes detent lever 31 and rocker 25 upward. Rocker 25 moves upward into it EARTH position by pivoting around first pin 26.

As a result of the pivoting movement of rocker 25, blocking detent 58 moves below fixed stop 57 and is engaged behind hook 31*a* of detent lever 31.

Cam roller 35 now abuts, as before, curved surface 37 of rocker arm 38, which is prevented from rotating by detent 45.

There has thus been shown and described a novel apparatus for a driving mechanism for a three-position electrical switch which fulfills all the objects and advantages sought. Many changes, modifications, variations and other uses and applications of the subject invention will, however, become apparent to those skilled in the art after considering this specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A driving mechanism for a three-position electrical switch, comprising:

a jump-drive sub-assembly having a switching shaft which is rotatable between ON, OFF and EARTH switching positions;

a pivotable actuator operable to rotate the switching shaft between its switching positions;

a spring arrangement coupled with the actuator and operable to store spring energy upon rotation of the actuator in either direction from a mean position;

a detent arrangement coupled with the switching shaft and with the spring arrangement;

a circumferentially spaced arrangement of latches disposed around the switching shaft and engageable with the detent arrangement in order to hold the switching shaft in any one of its switching positions;

a release arrangement coupled with the actuator and operable, upon rotation of the actuator from the mean position through a predetermined angle, to disengage the detent arrangement from the latch arrangement and thereby allow the stored spring energy to act upon the switching shaft to rotate the latter rapidly to the ON position or to the EARTH position depending upon the direction of rotation of the actuator; and a storage drive assembly coupled with the switching shaft and having a disconnecting spring which is operable to release a stored spring force when a fuse of a fusing arrangement is blown or when an open circuit trip of a shunt trip arrangement has occurred;

wherein the switching shaft is operable automatically by the storage drive sub-assembly when a fuse is blown or when an open circuit trip has occurred, and the switching shaft is operable manually via the jump drive sub-assembly.

2. A driving mechanism for a three-position electrical switch, comprising:

a jump-drive sub-assembly having a switching shaft which is rotatable between ON, OFF and EARTH positions;

a pivotable actuator operable to rotate the switching shaft between its switching positions, the pivotable actuator comprising a sleeve, a helical spring surrounding the sleeve, a first retainer secured to the sleeve and engageable with one end of the spring, and a second retainer secured to the switching shaft and engageable with another end of the spring;

a releasable detent arrangement coupled with the switching shaft and with the spring, the arrangement comprising a detent carrier secured to the shaft and carrying a pair of detents, and circumferentially spaced pairs of latching rollers fixedly arranged around the switching shaft to each determine a respective one of said switching positions when engaged by the detents;

a manually operated lever secured to the sleeve to rotate the latter in a direction from OFF to ON and from OFF to EARTH and vice versa, thereby taking with it, via the first retainer, the end of the spring which is in its path, while the other end of the spring is held by the second retainer, and the detents are engaged with the rollers associated with the starting position;

a release device secured to the sleeve for rotation therewith and operable, when the particular spring end engaged by the first retainer has moved through a predetermined angle, to release the detent situated in the relevant direction of rotation from engagement with its roller so that the switching shaft and the detent carrier are then rotated rapidly by the action of the other end of the spring and the second retainer from OFF to ON, from OFF to EARTH and from EARTH to OFF; and a storage drive sub-assembly comprising a disconnecting spring which has its spring force releasable when a fuse of a fusing arrangement is blown or when an open circuit trip of a shunt trip arrangement has occurred;

wherein, (1) a crank lever is secured to the switching shaft and engages a switch rod of the storage drive subassembly, said switch rod carrying a support roller and said disconnecting spring;

(2) the disconnecting spring is attached at one end to an end of the switch rod remote from the crank lever and is attached at its other end to a rocker pivotally mounted on a first pin which engages a first slot formed in the switch rod and a plate;

(3) the plate receives a second pin which engages a second slot formed in the switch rod and which forms the axis of rotation for a detent lever which is pivotable with a detent shoulder arranged adjacent to said support roller;

(4) the detent lever has a recessed seat for receiving said support roller and carries a cam roller urged under spring force to engage a rocker arm pivotable about a fixed axis;

(5) the detent shoulder of the detent lever lies on an arc which is eccentric to the axis of rotation of the detent lever;

(6) the free end of said rocker arm is engageable by a support detent and by a blocking pawl to hold the free end and prevent the rocker arm from pivoting, the support detent being movable out of a blocking position by a connecting link connected to said crank lever, and the blocking pawl being movable out of the blocking position via a trip rod controlled by a fusing arrangement and/or an open circuit trip of a shunt trip arrangement;

(7) a blocking detent is pivotally mounted on said rocker for movement under spring action below a fixed stop, said blocking detent being movable against the spring action to engage with a hook of said detent lever, and the end of the blocking detent facing said fixed stop lying on an arc eccentric to the pivot axis of the blocking detent; and (8) the hook of said detent lever lies on an arc eccentric to said second pin.

* * * * *